United States Patent [19]

Horodysky et al.

[11] Patent Number: 4,536,309

[45] Date of Patent: Aug. 20, 1985

[54] ZWITTERIONIC QUATERNARY AMMONIUM SULFONATES AND SULFATES AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 403,264

[22] Filed: Jul. 29, 1982

[51] Int. Cl.[3] ..... C10M 1/32; C10M 1/38

[52] U.S. Cl. ..... 252/33; 252/50; 252/402; 260/501.15

[58] Field of Search ..... 252/33, 50, 402; 260/501.15

[56] References Cited

U.S. PATENT DOCUMENTS

| | | | |
|---|---|---|---|
| 2,697,116 | 12/1954 | Stayner | 252/33 |
| 2,699,991 | 1/1955 | Stayner et al. | 252/33 |
| 3,431,265 | 3/1969 | Wakeman et al. | 252/33 |

*Primary Examiner*—Jacqueline V. Howard

*Attorney, Agent, or Firm*—Alexander J. McKillop; Michael G. Gilman; Van D. Harrison, Jr.

[57] ABSTRACT

Zwitterionic Quaternary ammonium sulfates, and sulfonates are provided as new compounds and as highly effective additives to lubricants and liquid fuels. They have a variety of desirable effects, among them being their ability to reduce friction in an internal combustion engine, thereby reducing the amount of fuel consumed.

27 Claims, No Drawings

ZWITTERIONIC QUATERNARY AMMONIUM SULFONATES AND SULFATES AND LUBRICANTS CONTAINING SAME

BACKGROUND OF THE INVENTION

1. Field of the Invention

The invention is concerned with a novel group of compounds and their use in lubricants or liquid fuels as friction reducers, antioxidants and antiwear corrosivity reducers (i.e., non-corrosive to copper).

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them. Also, no art is known that teaches or suggests the use of the instant compounds in a lubricant or fuel.

SUMMARY OF THE INVENTION

In accordance with the invention, there is provided a compound of the formula

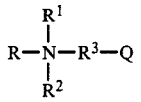

wherein (1) R is a $C_1$ to $C_{30}$ hydrocarbyl group, preferably a $C_8$ to $C_{30}$, hydrocarbyl group, or is selected from the formulas

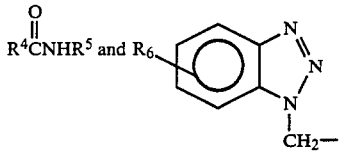

wherein $R^4$ is a $C_1$ to $C_{30}$ hydrocarbyl group, preferably a $C_7$ to $C_{30}$ hydrocarbyl group, $R^5$ is preferably a $C_2$ to $C_4$ alkyl group and $R^6$ is hydrogen or a methyl group, (2) $R^1$ and $R^2$ are $C_1$ to $C_{30}$ hydrocarbyl group, preferably methyl or a $C_8$ to $C_{30}$ hydrocarbyl group, (3) $R^3$ is benzyl or $C_2$ to $C_6$ alkylene group and (4) Q is a sulfonate or sulfate group.

The invention also provides a lubricant or liquid hydrocarbon fuel composition comprising a lubricant or fuel and a friction reducing or antiwear amount of the product. It is further contemplated that the product will aid in the reduction of fuel consumption in an internal combustion engine.

DESCRIPTION OF SPECIFIC EMBODIMENTS

The compounds of this invention can be made by methods generally known to the prior art. In general the sulfonates can be made by reacting the appropriate ammonium halide with, e.g., chlorosulfonic acid and the sulfates of the invention can be made by reacting the appropriate amine or amidoamine with, e.g., a chloroalkyl sulfate such in accordance with the following illustrative reactions:

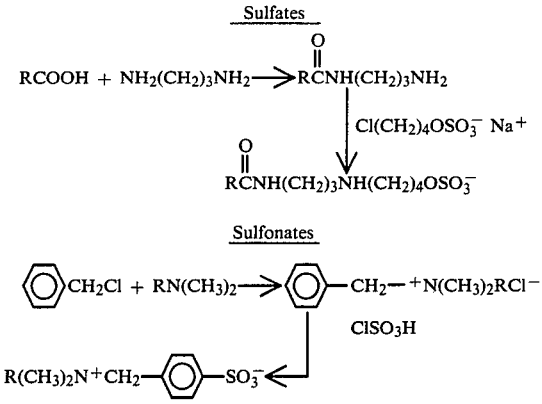

The chlorosulfonic acid is readily available commercially and its preparation is well known. The sulfates are generally available also, but a useful sulfate can be prepared by reacting chlorobutanol and chlorosulfonic acid set forth herein below.

The reaction between the ammonium halide and chlorosulfonic acid can be carried out at from about 20° C. to about 90° C., preferably from about 25° C. to 60° C. The reaction between the amine and sulfate can be carried out at from about 80° C. to about 140° C., preferably from about 90° C. to about 120° C. The temperature chosen will depend to some extent on the particular reactants and on whether or not a solvent is used. In carrying out the reactions, it is preferable that quantities of reactants be chosen such that the ratio of ammonium halide, amine or amidoamine to the sulfating or sulfonating agent is from about 1:4 to about 1:1, preferably about 1:2 to about 1:1.

While atmospheric pressure is generally preferred, the reaction can be advantageously run at from about 1 to about 5 atmospheres. Furthermore, where conditions warrant it, a solvent is preferred. In general, any relatively unreactive solvent can be used, including ethylene dichloride, and chloroform.

The times for the reactions are not critical. Thus, any phase of the process can be carried out in from about 1 to about 50 hours.

In the above formulas, "hydrocarbyl," includes alkyl, alkenyl, aryl, aralkyl and alkaryl groups. These specifically include, but are not limited to, alkyl groups of from 1 to 30 carbon atonms, such as methyl, propyl, butyl, octyl, decyl, mixed $C_{12}$–$C_{18}$, octadecyl (including the coco group) and alkenyl groups of from 6 to 30 carbon atoms, such as the oleyl group. The heterocyclic groups contemplated include the methylbenzotriazole group.

"Hydrocarbylene" as used hereinabove, is of essentially the same scope as "hydrocarbyl". It specifically includes alkylene groups having 1 to 30 carbon atoms as well as the benzyl group.

Of particular significance, in accordance with the present invention, is the ability to improve the resistance to oxidation and corrosion of oleaginous materials such as lubricating media which may comprise liquid oils, in the form of either a mineral oil or a synthetic oil, or mixtures thereof, or in the form of a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accouting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oil employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylehexyl)sebacate, di(2-ethylhexyl)adipate, dibutyl phthalate, flourocarbons, silicate esters, silanes, esters of phosphorous-containing acids, liquid ureas ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl)ether, phenoxy phenylethers.

It is to be understood, however, that the compositions contemplated herein can also contain other materials. For example, corrosion inhibitors, extreme pressure agents, viscosity index improvers, pour depressants, detergants, dispersants, coantioxidants, antiwear agents and the like can be used, including but not limited to phenates, sulfonates, succinimides, zinc dialkyl dithiophosphates, polymethacylates, olefin copolymers, and the like. These materials do not detract from the value of the compositions of this invention, rather the materials serve to impart their customary properties to be particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions." Specifications for low-temperature and airfcraft fluids are defined in U.S. Government Specification MIL-H-5606A.

In addition, the oxidation and corrosion resistance of functional fluids such as hydraulic fluids can be improved by the adducts of the present invention.

The fuels that may be used for the purposes of this invention include (1) liquid hydrocarbon fuel, such as diesel oil, fuel oil and gasoline, (2) alcohol fuels such as methanal and ethanol and (3) mixtures thereof.

In general, the reaction products of the present invention may be employed in any amount which is effective for imparting the desired degree of friction reduction or antiwear activity. In many applications, however, the product is effectively employed in amounts from about 0.1% to about 10% by weight, and preferably from about 1% to about 5% of the total weight of the composition.

The following Examples will present illustrations of the invention. They are illustrative only, and are not meant to limit the invention.

EXAMPLE 1

Synthesis of p-sulfobenzyl-N-alkyl-N,N-dimethyl ammonium inner salt

A 2 liter round bottom flask was equipped with an overhead stirrer, Barrett trap, condenser and drying tube, thermometer, and nitrogen bleed. Approximately 109 g of benzalkonium chlorides (obtained commercially having $C_{12}$ to $C_{18}$ alkyl with $C_{15}$ average) and 750 g of ethylene dichloride were charged to the flask. 100 cc of solvent was removed by distillation to eliminate trace $H_2O$ impurity. Then 278 g of chlorosulfonic acid was added to the reaction dropwise with the reaction temperature maintained at 25° C. After addition, the temperature was raised to 58° C., and the reaction proceeded for 24 hours. The reaction was chilled in an ice bath, and 250 cc $H_2O$ was added dropwise. Aqueous sodium hydroxide (50%) was added slowly until a pH of 7 was obtained using a pH meter. 95% ethanol was added and all solvents were removed by vacuum distillation. The resulting dark brown residue was stirred in warm acetone, filtered, and allowed to sit overnight. The acetone solution was filtered through diatomaceous earth. Solvent was removed by vacuum distillation yielding a reddish-brown viscous oil.

EXAMPLE 2

Synthesis of p-sulfobenzyl-N,N-di-hydrogenated-tallow-N-methyl ammonium inner salt 205 g of N,N-dihydrogenated-tallow-N-methyl amine and 50 g of benzyl chloride were heated at 95°-100° C.

for 15 hours to yield N,N-dihydrogenated-tallow-N-methylbenzyl ammonium chloride, a waxy, pale-yellow solid. Then 100 g of this benzyl ammonium chloride was charged to a 1 liter round bottom flask equipped with overhead stirrer, thermometer, and $N_2$ bleed. 400 cc dry ethylene dichloride was added, and 109 g of chlorosulfonic acid was added dropwise over a 2½ hour period with the reaction temperature held at 20°–25° C. Reaction was allowed to proceed at 52° C. for 20 hours. The reaction solution was chilled in an ice bath and water was added dropwise followed by 6N NaOH. The pH was adjusted to 7, and all solvents were removed by vacuum distillation. Toluene was added, insoluble salts were removed by filtration, and toluene was removed from the filtrate by vacuum distillation. The residue was dissolved in acetone and allowed to sit overnight. A slight precipitate was filtered, and acetone was removed by vacuum distillation to yield a dark brown oil.

EXAMPLE 3

Synthesis of p-sulfobenzyl-N,N-dicoco-N-methyl ammonium inner salt 196 g of N,N-dicoco-N-methyl amine and 61 g of benzyl chloride were heated at 100° C. for 15 hours to yield N,N-dicoco-N-methyl benzyl ammonium chloride, a waxy, pale yellow solid. Then 100 g of the benzyl ammonium chloride was charged to a 1 liter flask equipped with overhead stirrer, thermometer, and $N_2$ bleed. 500 cc dry ethylene dichloride was added, and 128 g of chlorosulfonic acid was added dropwise over a 2½ hour period with the reaction temperature held at 20°–25° C. Reaction was allowed to proceed at 52° C. for 20 hours. The reaction was chilled in an ice bath, and water was added dropwise, followed by 6N NaOH. The pH was adjusted to 7, and all solvents were removed by vacuum distillation. Toluene was added, insoluble salts were removed by filtration, and toluene was removed from the filtrate by vacuum distillation. The residue was dissolved in acetone and the resulting slight precipitate was filtered. Acetone was removed from the filtrate to yield a dark brown oil.

EXAMPLE 4

Synthesis of sodium 4-chloro-1-butane sulfate

A 1 liter round bottom flask was equipped with an overhead stirrer, thermometer, condenser and addition funnel with $N_2$ inlet. 101 g of 4-chlorobutanol and 200 cc dry chloroform were charged to the flask and chilled to −30° C. 141 g of chlorosulfonic acid was added dropwise with the reaction being allowed to warm to 0° C. during addition. Reaction was allowed to warm to room temperature and stir for 1 hour. The reaction solution was chilled again to −30° C., and 300 cc chilled methanol was added followed by 104 g of 50% NaOH. Reaction was allowed to warm to room temperature, and precipitated solids were filtered and discarded. Filtrate was stripped free of solvents, and toluene was added and distilled to azeotrope water in the solution. The resulting crude tan viscous solid was filtered free of salts after refluxing in methanol. Methanol was concentrated, and the white crystalline product, sodium 4-chloro-1-butane sulfate, crystallized and was filtered.

EXAMPLE 5

Synthesis of N-(4-sulfatobutyl)-N,N-dioleyl-N-(3-methylbenzotriazole)ammonium inner salt 23 g of sodium 4-chloro-1-butane sulfate, prepared as described in Example 4, and N,N-dioleyl-N-(3-methylbenzotriazole)amine were refluxed in 400 cc n-butanol for 41 hours. n-Butanol was removed by vacuum distillation. The residue was dissolved in 95% ethanol, and the pH was adjusted to 10. The resulting ppt was filtered, and the solvent removed by vacuum distillation. The dark brown filtrate was dissolved in toluene. Insoluble salts were filtered over diatomaceous earth and toluene was removed from the filtrate by vacuum distillation to yield a dark brown oil.

EXAMPLE 6

Synthesis of N-(4-sulfato butyl)-N,N-dicoco-N-methyl ammonium inner salt 25 g of sodium 4-chloro-1-butane sulfate, prepared as described in Example 4, and 48 g of N,N-dicoco-N-methyl amine were refluxed at 106° C. in 400 cc n-butanol for 42 hours. n-Butanol was removed by vacuum distillation. The residue was dissolved in 95% ethanol, and the pH was adjusted to 10. After the alcohol was removed by distillation, the resulting residue was dissolved in toluene and filtered through diatomaceous earth. Vacuum distillation of toluene from the filtrate yielded an off-white, waxy solid product.

EXAMPLE 7

Synthesis of sodium 2-chloroethane sulfate

A 2 liter round bottom flask was equipped with an overhead stirrer, thermometer, condenser and addition funnel with $N_2$ lnlet. 216 g of 2-chloroethanol and 550 cc of dry chloroform were charged to the flask and chilled to −30° C. Chlorosulfonic acid was added dropwise in one hour, and the reaction was allowed to warm to room temperature and stir for 1½ hours. With the reaction solution again at −30° C., cold methanol was added dropwise followed by 300 g of 50% NaOH solution. The reaction was heated to reflux and filtered hot. The filtrate crystallized upon standing yielding white crystals, which were filtered and washed with cold methanol to yield sodium 2-chloroethane sulfate.

EXAMPLE 8

Synthesis of N-(2-sulfatoethyl)-N,N-dimethyl-N-(3-phenyl stearamidopropyl)ammonium inner salt Approximately 250 g of phenyl stearic acid and 100 g of N,N-dimethylpropylene diamine were refluxed in 400 cc of xylene at 143° to 147° C. until all water formed in the reaction had been removed via azeotropic distillation. The reaction solution was filtered through diatomaceous earth. Xylene and excess amine were removed from the filtrate by vacuum distillation to yield a clear, brown liquid product. The 100 g of this 3-phenyl stearylamidopropylamine and 38 g of sodium 2-chloroethane sulfate, prepared as described in Example 7, were refluxed in 500 cc of n-butanol at 110° C. for 72 hours. The reaction solution was filtered, and solvent was removed from the filtrate by vacuum distillation. The residue was dissolved in 95% ethanol, and the pH was adjusted to 10.3. Solvent was removed, and the residue was dissolved in 800 cc of hot toluene and filtered. Removal of toluene from the filtrate via vacuum distillation yielded a viscous orange-brown product.

EXAMPLE 9

Synthesis of N-(2-sulfatoethyl)-N,N-dimethyl-N-(3-oleamidopropyl-)ammonium inner salt Approximately 390 g of oleic acid and 278 g of N,N-dimethylpropylene diamine were refluxed in 1000 cc of xylene at 136° to 143° C. until all water formed in the reaction had been removed via azeotropic distillation. The reaction solution was filtered through diatomaceous earth. Xylene and excess amine were removed from the filtrate by vacuum distillation to yield a clear, brown liquid product. Then, 81 g of this 3-oleamidopropylamine and 38 g of sodium 2-chloroethane sulfate, prepared as described in Example 7, were refluxed in 500 cc of n-butanol at 110° C. for 53 hours. The reaction solution was filtered, and some solvent was removed by vacuum distillation. 95% ethanol was added, the pH was adjusted to 11, and solvents were removed by distillation. The residue was dissolved in 600 cc of warm toluene and filtered through diatomoceous earth. Toluene was removed from the filtrate by vacuum distillation to yield a dark brown fluid product.

EXAMPLE 10

Synthesis of N-(2-sulfatoethyl)-N,N-dicoco-N-methyl ammonium inner salt

Approximately 103 g of N,N-dicoco-N-methyl amine and 48 g of sodium 2-chloroethane sulfate, prepared as described in Example 7, were refluxed in 800 cc of n-butanol at 110° C. for 50 hours. Solvent was removed by vacuum distillation. The residue was dissolved in 800 cc 90% ethanol, and the pH was adjusted to 10. Solvent was removed, and the residue was dissolved in aqueous isopropanol and extracted with petroleum ether. The petroleum ether layer was dried over $Na_2SO_4.MgSO_4$, filtered, and stripped free of solvent. The resulting product was a viscous, white, waxy solid.

EXAMPLE 11

Synthesis of N-(2-sulfatoethyl)-N,N-dimethyl-N-oleyl ammonium inner salt

Approximately 159 g of N,N-dimethyl-N-oleyl amine and 2-chloroethanol were heated at 85° C. for 5½ hours. Excess 2-chloroethanol was removed by vacuum distillatin to yield a viscous, orange, waxy solid. Then, 103 g of this N,N-dimethyl-N-(2-hydroxyethyl)-N-oleyl ammonium chloride was dissolved in 800 cc dry chloroform and chilled to 0° C. 44 g of chlorosulfonic acid was added dropwise in 45 min. The reaction mixture was stirred at room temperature for 2 hours, rechilled to 0° C., and quenched with 800 cc methanol. The reaction was neutralized to pH 7, filtered, and stripped free of solvents. The residue was dissolved in 800 cc toluene and allowed to sit overnight. A fine white precipitate was filtered, and toluene was removed from the filtrate via vacuum distillation. The residue was dissolved in 50:50 hexane:toluene and filtered. Solvents were removed from the filtrate by distillation to yield a viscous orange-brown, waxy solid.

EVALUATION OF THE COMPOUNDS

The compounds were evaluated in a low velocity Friction Apparatus (LVFA) in a fully formulated 5W-30 synthetic automotive engine oil containing a package including antioxidant, dispersant and detergent and having the following general characteristics:

Viscosity@100° C.—11.0
Viscosity@40° C.—58.2
Viscosity Index—172

This oil is referred to as the base oil. The test compound was 1, 2 and 4% of the total weight of oil.

Description

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangement.

Procedure

The rubbing surfaces and 12–13 ml of test lubricants are placed on the LVFA. A 240 psi load is applied, and the sliding speed is maintained at 40 fpm at ambient temperature for a few minutes. A plot of coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

Evaluation of Friction Reducing Characteristics

| Medium and Additive | Additive Conc., Wt. % | % Change in Coefficient of Friction @ 5 Ft./Min. | 30 Ft./Min. |
|---|---|---|---|
| Base Oil | — | 0 | 0 |
| Example 1 | 2 | 23 | 20 |
| Example 2 | 4 | 17 | 14 |
| Example 3 | 4 | 25 | 22 |
| Example 5 | 4 | 12 | 13 |
| Example 6 | 4 | 29 | 18 |
| Example 8 | 4 | 18 | 16 |
| Example 9 | 4 | 31 | 21 |
| | 2 | 26 | 23 |
| | 1 | 19 | 11 |
| Example 10 | 2 | 21 | 18 |
| Example 11 | 2 | 32 | 23 |
| | 1 | 25 | 19 |

Representative samples of the above prepared compositions were also evaluated for antioxidant properties with a catalytic oxidation test. Samples of 200" solvent paraffinic neutral mineral lubricating oil were placed in an oven at 325° F. Present in the samples were the following metals, either known to catalyze organic oxidation or commonly used materials of construction:

a. 15.6 sq. in. of sand-blasted iron wire
b. 0.78 sq. in. of polished copper wire
c. 0.87 sq. in. of polished aluminum wire
d. 0.167 sq. in. of polished lead surface.

Dry air was passed through the sample at a rate of about 5 liters per hour for 40 hours. Table 2 shows the data.

TABLE 2

| Medium and Additive | Additive Conc. Wt. % | Catalytic Oxidation Test 40 Hours @ 325° F. Lead Loss, mg | % Increase in Viscosity of Oxidized Oil Using KV @ 210° F. | Neut. No., NN |
|---|---|---|---|---|
| Base Oil | — | −0.2 | 4.2 | 3.53 |
| Example 1 | 2 | −0.03 | 5.5 | 2.62 |
| Example 3 | 2 | −0.7 | 5.4 | 2.62 |
| Example 9 | 4 | −0.6 | 3.7 | 2.85 |
| | 2 | −0.08 | 5.0 | 2.82 |
| Example 11 | 2 | −0.4 | 3.0 | 3.17 |

These products were non-corrosive to copper as measured in 200" solvent paraffinic neutral lubricating oil using the ASTM D130-80 Copper Strip Corrosivity Test. This is shown in Table 3.

TABLE 3

| Medium and Additive | Additive Conc. Wt. % | Copper Strip Corrosivity Test Rating ASTM D130-80 3 Hrs. @ 250° F. | ASTM D130-80 6 Hrs. @ 210° F. |
|---|---|---|---|
| Base Oil | | 1A | 1A |
| Example 1 | 2 | 1A | 1A |
| Example 3 | 2 | 1A | 1A |
| Example 9 | 4 | 1A | 1B |
| Example 10 | 2 | 1A | 1A |

It is apparent from the above data that the products of this invention are effective in a variety of uses. That is, they reduce friction and thereby help to decrease fuel consumption, they are effective antioxidants and they are not corrosive to copper.

We claim:

1. A composition of the formula

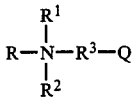

wherein (1) R, $R^1$ and $R^2$ are hydrocarbyl groups selected from the group consisting of $C_1$ to $C_{30}$ alkyl groups, $C_6$ to $C_{30}$ alkenyl groups and any mixtures thereof,
(2) $R^3$ is a $C_2$ to $C_6$ alkylene group or a benzyl group and
(3) Q is a sulfonate or a sulfate group.

2. The compound of claim 1 wherein the hydrocarbyl groups are alkyl, alkenyl, aryl, aralkyl and alkaryl groups.

3. The compound of claim 2 wherein the hydrocarbyl groups are alkyl groups.

4. The compound of claim 3 wherein the hydrocarbyl group is an alkenyl group of 6 to 30 carbon atoms.

5. THe compound of claim 1 having the formula

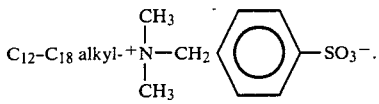

6. The compound of claim 1 having the formula

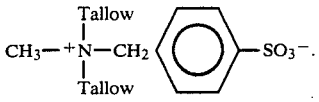

7. the compound of claim 1 having the formula

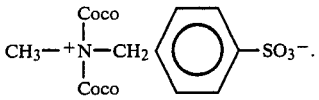

8. The compound of claim 1 having the formula

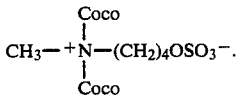

9. The compound of claim 1 having the formula

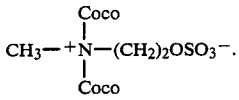

10. The compound of claim 1 having the formula

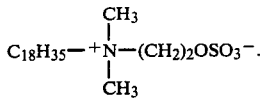

11. A lubricant composition comprising a major proportion of a lubricating oil or grease therefrom and a friction reducing amount of the formula

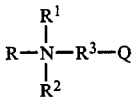

wherein (1) R, $R^1$ and $R^2$ are hydrocarbyl groups selected from the group consisting of $C_1$ to $C_{30}$ alkenyl groups and mixtures thereof,
(2) $R^3$ is a $C_2$ to $C_6$ alkylene group or a benzyl group and
(3) Q is a sulfonate or a sulfate group.

12. The composition of claim 11 wherein the hydrocarbyl groups are alkyl, alkenyl, aryl, aralkyl and alkaryl groups.

13. The composition of claim 12 wherein the hydrocarbyl groups are alkyl groups.

14. The composition of claim 13 wherein the hydrocarbyl group is an alkenyl group of 6 to 30 carbon atoms.

15. The composition of claim 11 wherein the compound has the formula:

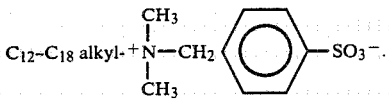

16. The composition of claim 11 wherein the compound has the formula:

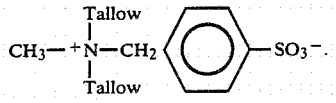

17. The composition of claim 11 wherein the compound has the formula:

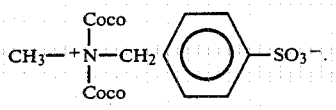

18. The composition of claim 11 wherein the compound has the formula:

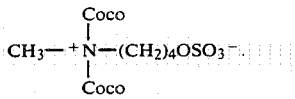

19. The composition of claim 11 wherein the compound has the formula:

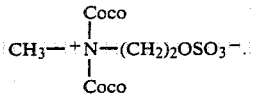

20. The composition of claim 11 wherein the compound has the formula:

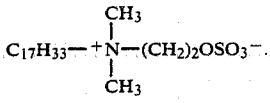

21. The composition of claims 11, 12, 13, 14, 15, 16, 17, 18, 19, or 20 wherein the lubricant is a lubricating oil.

22. The composition of claim 21 wherein the lubricating oil is (1) a mineral oil, (2) a synthetic oil or mixtures thereof or (3) a mixture of 1 and 2.

23. The composition of claim 21 wherein the lubricating oil is a mineral oil.

24. The composition of claim 21 wherein the lubricating oil is a synthetic oil or mixtures of synthetic oils.

25. The composition of claim 11 wherein the lubricant is a grease.

26. The compound of claim 1 wherein the alkyl group is methyl, propyl, butyl, octyl, decyl, mixed $C_{12}$–$C_{18}$ or octadecyl.

27. The composition of claim 11 wherein the alkyl group is methyl, propyl, butyl, octyl, decyl, mixed $C_{12}$–$C_{18}$ or octadecyl.

* * * * *

UNITED STATES PATENT AND TRADEMARK OFFICE

CERTIFICATE OF CORRECTION

PATENT NO. : 4,536,309

DATED : August 20, 1985

INVENTOR(S) : Andrew G. Horodysky et al

It is certified that error appears in the above-identified patent and that said Letters Patent is hereby corrected as shown below:

Column 1, line 42, after "$C_{30}$" delete comma (,).

Signed and Sealed this

*Twenty-eighth* Day of *January 1986*

[SEAL]

*Attest:*

DONALD J. QUIGG

*Attesting Officer*

*Commissioner of Patents and Trademarks*